United States Patent [19]

Riggs, Jr.

[11] Patent Number: 4,477,320

[45] Date of Patent: Oct. 16, 1984

[54] METHOD OF PREPARING ELECTROLYTIC MANGANESE DIOXIDE

[75] Inventor: Olen L. Riggs, Jr., Bethany, Okla.

[73] Assignee: Kerr-McGee Chemical Corporation, Oklahoma City, Okla.

[21] Appl. No.: 583,779

[22] Filed: Feb. 27, 1984

[51] Int. Cl.[3] ..... C25B 1/00

[52] U.S. Cl. ..... 204/96; 204/293; 420/497; 420/499

[58] Field of Search ..... 204/293, 96; 420/497, 420/499

[56] References Cited

U.S. PATENT DOCUMENTS 2,559,031 7/1951 Sykes ..... 420/497

4,140,617 2/1979 Dzhaparidze et al. ..... 204/96

4,170,527 10/1979 Beer et al. ..... 204/96

*Primary Examiner*—R. L. Andrews

*Attorney, Agent, or Firm*—William G. Addison; John P. Ward

[57] ABSTRACT

A method for the preparation of electrolytic manganese dioxide is provided employing improved cathodes, said cathodes being characterized by their reduced tendency to corrode and undergo buildup of current inhibiting scale under electrolytic conditions. The improved cathodes are fabricated from copper comprised of at least about 99.95 weight percent of copper, from about 0.001 to about 0.085 weight percent of silver and up to about 0.003 weight percent of phosphorous. The weight ratio of phosphorous to silver in said copper cathode will be no greater than about 2.0 to 1.0.

4 Claims, No Drawings

METHOD OF PREPARING ELECTROLYTIC MANGANESE DIOXIDE

FIELD OF THE INVENTION

The present invention relates to an improvement in a method for preparing electrolytic manganese dioxide. More particularly, the invention relates to an improved, more efficient method for preparing electrolytic manganese dioxide utilizing cathodes constructed from particular copper compositions, said cathodes characterized by having a reduced tendency to corrode and undergo build-up of current inhibiting scales when contacted with aqueous acidic salt solutions and vapors thereof under electrolytic conditions.

BACKGROUND OF THE INVENTION

The manufacture of manganese dioxide by electrolysis of an aqueous manganese sulfate/sulfuric acid electrolyte solution in an electrolytic cell is well known. In general, such process involves the passage of an electric current between one or more pairs of electrodes (i.e., a cathode and an anode) submersed in the aqueous electrolyte solution to cause dissociation of the manganese sulfate into manganese ($Mn^{+2}$) and sulfate ions. The $Mn^{+2}$ ions thus formed then undergo anodic oxidation to form a deposit of manganese dioxide on the anode which anode may be a structure of any of the known materials employed for such use such as lead alloys, graphite, titanium, tantalum, zirconium and the like, and from which the manganese dioxide is subsequently stripped and recovered.

Many materials have been suggested and employed for fabricating cathodic structures for use in electrolytic cells for the manufacture of electrolytic manganese dioxide. Included among such suggested and employed materials are, for example, copper, graphite, mild steel, nickel, platinum and the like. Of these materials, copper is the most commonly employed. However, a disadvantage associated with the use of copper as a cathodic material is its ready tendency to undergo corrosion when contacted with aqueous acidic salt solutions or vapors thereof under electrolytic conditions. As a result of this corrosion, contamination of the manganese dioxide end product with copper oxidization products can occur. The presence of such oxidation products in the manganese dioxide in turn leads to a decrease in both the shelf life and discharge capacity of dry cell batteries manufactured from such contaminated manganese dioxide.

In addition to contamination of the manganese dioxide product, corrosion of cathodes fabricated from copper also adversely affects the overall efficiency and economics of electrolytic processes employing such cathodes. For example, corrosion of the copper cathodes leads to the formation of current inhibiting scales thereon giving rise to increased power demands by the electrolytic cell for the production of a given quantity of the desired electrolytic product and a corresponding increase in production costs. The formation of current inhibiting scales on copper cathodes also gives rise to a need for more frequent replacement of such cathodes than is encountered with cathodes fabricated from other materials such as, for example, graphite. Thus, the need for more frequent replacement of copper cathodes further adds to the cost of producing manganese dioxide by electrolytic processes.

SUMMARY OF THE INVENTION

In accordance with the present invention there is now provided an improvement in a method for preparing manganese dioxide by electrolysis of aqueous solutions containing manganese sulfate and sulfuric acid. The improvement comprises the utilization of cathodes which are characterized by significantly reduced tendencies to corrode and undergo build-up of current inhibiting scales. The cathodes useful in the improved process of this invention are fabricated from copper comprising at least about 99.95 weight percent of copper, from about 0.001 to about 0.085 weight percent of silver and up to about 0.003 weight percent of phosphorous. Furthermore, the weight ratio of phosphorous to silver in said copper will be of a magnitude of no greater than about 2.0 to 1.0.

DETAILED DESCRIPTION OF THE INVENTION

As disclosed hereinabove, it is known to employ copper, to fabricate cathodic structures for use in electrolytic processes for the manufacture of electrolytic manganese dioxide. Generally, the copper that has been employed in fabricating such cathodic structures has been that known in the copper industry as deoxidized tough pitch coppers. Deoxidized tough pitch coppers consist of those coppers which have been either electrolytically or fire-refined and which are in a tough pitch condition, i.e., containing controlled amounts of oxygen for purposes of obtaining a level set upon the casting thereof, but that are deoxidized through the addition thereto of a metallic or metalloid deoxidizer.

Many different metallic or metalloid deoxidizers have been employed to deoxidize electrolytically or fire-refined coppers in a tough pitch condition including phosphorous, calcium, silicon, lithium, beryllium, aluminum, magnesium and the like. Of these, phosphorous is the most widely used material for deoxidizing these coppers in a tough pitch condition.

It is known that the use of such metals or metalloids to deoxidize copper can seriously affect the electrical conductivity of the copper. Thus, the amount of metal or metalloid added to deoxidize the copper must be controlled carefully to make certain that very little of the metal or metalloid remains in the copper. For example, to obtain a refined, high-conductivity grade copper using phosphorous as a deoxidizer, the residual phosphorous must not exceed about 0.012 weight percent of the total weight of the copper. At residual phosphorous contents greater than about 0.012 weight percent, appreciable decreases in the electrical conductivity of the copper are encountered. Generally, such high conductivity grade copper will contain residual amounts of phospherous ranging from as low as 0.004 weight percent to as high as 0.012 weight percent.

It now has been discovered that, in addition to the known decrease in the conductivity of a refined copper caused by the presence therein of residual phosphorous in amounts greater than 0.012 weight percent, that an amount of residual phosphorous greater than 0.004 and more particularly greater than about 0.003 weight percent also results in an accelerated rate of corrosion of cathodes fabricated from such refined copper when subjected to elevated temperatures in the presence of hydrogen. Of course, in electrolytic processes for the manufacture of electrolytic manganese dioxide employing cathodes fabricated from copper, said cathodes are, in fact, subjected to elevated temperatures in the presence of hydrogen and undergo corrosion at their surfaces both within the electrolytic solution as well as within the aqueous acidic vapor space above the electrolyte solution. Based on experimentation and observation, it now has been found that cathodes fabricated from refined deoxidized copper containing up to at most about 0.003 weight percent of phosphorous exhibit both reduced rates of corrosion and substantially minimal or no build-up of current inhibiting scale.

The refined copper employed to fabricate the cathodes for use in the improved process of the present invention also will contain silver. For reasons not fully understood, the presence of silver in combination with the lower levels of phosphorous further enhances the corrosion resistance of cathodes fabricated from copper. Thus, the copper employed in fabricating cathodes for use in the present invention will contain silver in amounts ranging from about 0.001 to about 0.085 weight percent based on the total weight of the copper. A more preferred range for the silver is that of from about 0.002 to about 0.085 weight percent based upon the total weight of the copper.

In addition, the weight ratio of phosphorous to silver in the copper employed to fabricate the cathodic structures employed in the present invention has been found to be a critical consideration if a substantial reduction in the rate of corrosion of and minimal or no build-up of current inhibiting scale on said cathodic structures is to be realized. For example, it has been observed that cathodic structures fabricated from copper containing phosphorous and silver in weight ratios greater than about 2.0 to 1.0 exhibit increased rates of corrosion even though the phosphorous content of the copper in said structures does not exceed the maximum amount of about 0.003 weight percent as specified herein. This increase in corrosion is particularly noticeable on those surfaces of the cathodic structures exposed to the aqueous acidic vapors in the space immediately above the surface of the aqueous electrolyte solution. Therefore, in order to provide for copper based cathodes useful in the practice of the present invention, copper containing both phosphorous and silver within the above weight percent ranges must additionally contain these materials in weight ratios of phosphorous to silver up to about 2.0 to 1.0 and preferably in ratios of phosphorous to silver up to about 1.5 to 1.0.

The electrolytes useful in the present invention are those electrolytes containing a source of manganese (II) ions in amounts ranging from about 20 to about 100 grams per liter and sulfuric acid in amounts ranging from about 5 to about 75 grams per liter of electrolyte. The preferred amounts range from about 30 to about 50 grams per liter for $Mn^{+2}$ ion and from about 15 to about 25 grams per liter for the sulfuric acid.

The temperature of the electrolyte in the electrolytic cell will be maintained at a temperature ranging from about 90° C. to about 100° C. The current density will be maintained within the range of from about 5 to about 15 amps per square foot. Particularly good results are achieved in the practice of this invention when the temperature of the electrolyte is in the range of from about 95° C. to about 98° C. and the current density is in the range of from about 8 to about 10 amps per square foot.

As disclosed hereinabove, the cathodes useful in the improved process of the present invention exhibit reduced rates of corrosion and minimal or no build-up of current inhibiting scale when contacted with an aqueous acidic electrolytic solution or vapors thereof under electrolytic conditions. The resistance of the cathodes employed in the process of the present invention to corrosion and scale build-up under these conditions is illustrated hereinbelow. In the following examples all parts and percentages are by weight unless otherwise specified.

EXAMPLES 1-3

A series of experiments was carried out to compare the rates of corrosion of electrolytic cell cathodes fabricated from three different copper compositions as identified in Table I below. All cathodes were tubular in shape and prior to insertion into the electrolytic test cell, thoroughly cleaned and dried. The electrolyte solution employed in this series was an aqueous acid solution containing 44.5 grams per liter (g/l) of sulfuric acid and 21.0 g/l of manganese sulfate as manganese (II) ion. All experiments were conducted for a period of 24 hours at an electrolyte solution temperature of 98° F. using graphite anodes. Current through the cell was provided by a PAR Potentiostat (in galvanostat mode) model 173. Data collected from this series of experiments and evidencing the corrosive effect or lack thereof of the phosphorous and silver content of the copper compositions from which the test cathodes were fabricated are set forth in Table I below.

TABLE I

| Expl. No. | Corrosion Rate, mpy[a] | | Composition of Cathode, wt % | | | Ratio, wt. P/Ag |
|---|---|---|---|---|---|---|
| | Immersed | Vapor Space | Phosphorous | Silver | Copper | |
| 1 | 0.7 | 6.4 | 0.003 | 0.0021 | 99.95 | 1.4/1.0 |
| 2 | 3.0 | 80.8 | 0.002 | 0.0008 | 99.90 | 2.5/1.0 |
| 3 | 1.4 | 236.6 | 0.035 | 0.0002 | 99.90 | 17.5/1.0 |

[a]mpy = milliinches per year

From the data presented in Table I above, it becomes readily apparent that the rate of corrosion of a copper cathode under electrolytic conditions is dependent not only on the amount of phosphorous and silver contained in the copper cathode but also on the ratio (on a weight basis) of phosphorous to silver contained therein. Furthermore, no current inhibiting scale build-up on the cathode tested in Example 1 was observed, whereas a loosely adhered, friable current inhibiting scale, analyzed as being calcium sulfate (anhydrite) and containing some copper and manganese, was observed to have formed on the comparative cathodes of Examples 2 and 3.

While the invention has been disclosed with respect to what at present are believed to be the preferred embodiments thereof, it is to be understood that this invention is not to be limited to these specific embodiments and that changes may be made in and to the invention without departing from the spirit and scope thereof except as provided in the following claims.

What is claimed is:

1. In a method for preparing manganese dioxide by electrolysis of an aqueous solution containing sulfuric acid and manganese sulfate, the improvement which comprises using as a cathode, copper comprised of at least about 99.95 weight percent of copper, from about 0.001 to about 0.085 weight percent of silver and up to about 0.003 weight percent of phosphorous, the weight ratio of phosphorous to silver in said copper being no more than about 2.0 to 1.0, said cathode having a reduced tendency to corrode and undergo build-up of current inhibiting scale.

2. The improvement of claim 1 wherein the copper in said cathode comprises about 0.0021 weight percent of silver and about 0.003 weight percent of phosphorous, the balance being copper metal.

3. The improvement of claim 2 wherein said copper cathode, when immersed in the aqueous solution containing sulfuric acid and manganese sulfate under electrolytic conditions, is characterized by a loss of copper, as copper ion, at a rate of about 3.0 milliinches or less per year.

4. The improvement of claim 2 wherein said copper cathode, when subjected to an aqueous vapor phase immediately adjacent to and above said aqueous solution containing sulfuric acid and manganese sulfate under electrolytic conditions, is characterized by a loss of copper, as copper ion, at a rate of about 100 milliinches or less per year.

* * * * *